US008141907B2

(12) United States Patent
Seiffarth

(10) Patent No.: US 8,141,907 B2
(45) Date of Patent: Mar. 27, 2012

(54) DOCUMENT PROTECTOR

(75) Inventor: Steffen Seiffarth, Stuttgart (DE)

(73) Assignee: Esselte Leitz GmbH & Co KG, Stuttgart (DE)

( * ) Notice: Subject to any disclaimer, the term of this patent is extended or adjusted under 35 U.S.C. 154(b) by 528 days.

(21) Appl. No.: 12/309,290

(22) PCT Filed: Jul. 24, 2007

(86) PCT No.: PCT/EP2007/057621

§ 371 (c)(1), (2), (4) Date: Jan. 13, 2009

(87) PCT Pub. No.: WO2008/017587

PCT Pub. Date: Feb. 14, 2008

(65) Prior Publication Data

US 2009/0189386 A1 Jul. 30, 2009

(30) Foreign Application Priority Data

Aug. 10, 2006 (DE) ..... 10 2006 037 611

(51) Int. Cl.
*B42D 3/00* (2006.01)

(52) U.S. Cl. ..... 281/31; 281/20

(58) Field of Classification Search ..... 40/359, 40/360; 281/31, 20, 45; 402/79
See application file for complete search history.

(56) References Cited

U.S. PATENT DOCUMENTS

| | | | | |
|---|---|---|---|---|
| 2,895,448 | A | 7/1959 | Haines | |
| 5,125,561 | A | 6/1992 | Idstein | |
| 5,186,565 | A * | 2/1993 | Jack | 402/79 |
| 5,678,943 | A * | 10/1997 | Parsons | 402/79 |
| 5,904,373 | A * | 5/1999 | Krapf | 281/29 |
| 6,183,158 | B1 * | 2/2001 | Lynton | 402/79 |

FOREIGN PATENT DOCUMENTS

| | | |
|---|---|---|
| AT | 280 944 | 4/1970 |
| DE | 815 484 | 10/1951 |
| DE | 945 444 | 7/1956 |
| DE | 1 104 488 | 4/1961 |
| DE | 1 993 936 | 9/1968 |
| DE | 1 536 654 | 1/1970 |
| DE | 17 86 291 | 1/1972 |
| DE | 85 07 000 | 5/1986 |
| DE | 40 14 222 | 11/1991 |
| DE | 44 21 689 | 1/1996 |
| DE | 201 11 135 | 12/2001 |
| EP | 0 142 489 | 5/1985 |
| GB | 1 172 044 | 11/1969 |
| GB | 1 242 619 | 8/1971 |
| GB | 2 385 024 | 8/2003 |

OTHER PUBLICATIONS

International Search Report.

* cited by examiner

*Primary Examiner* — Joanne Silbermann
*Assistant Examiner* — Christopher e Veraa
(74) *Attorney, Agent, or Firm* — Collard & Roe, P.C.

(57) ABSTRACT

The invention relates to a document folder (10, 110, 200) with a document pocket (12), defined by a front cover (14) and a back cover (16) made of plastic foil, used for holding documents, comprising a label strip (24) movable in relation to the document pocket (12) that, in a first position, extends at least partially beyond the outline of the document pocket (12) on one first side (20). According to the invention, the label strip (24) is permanently connected to the document pocket (12) and can be folded into a second position, around a fold (22) parallel to the first side (20), onto the front cover (14) or the back cover (16).

10 Claims, 8 Drawing Sheets

DOCUMENT PROTECTOR

CROSS REFERENCE TO RELATED APPLICATIONS

Figure 1A:
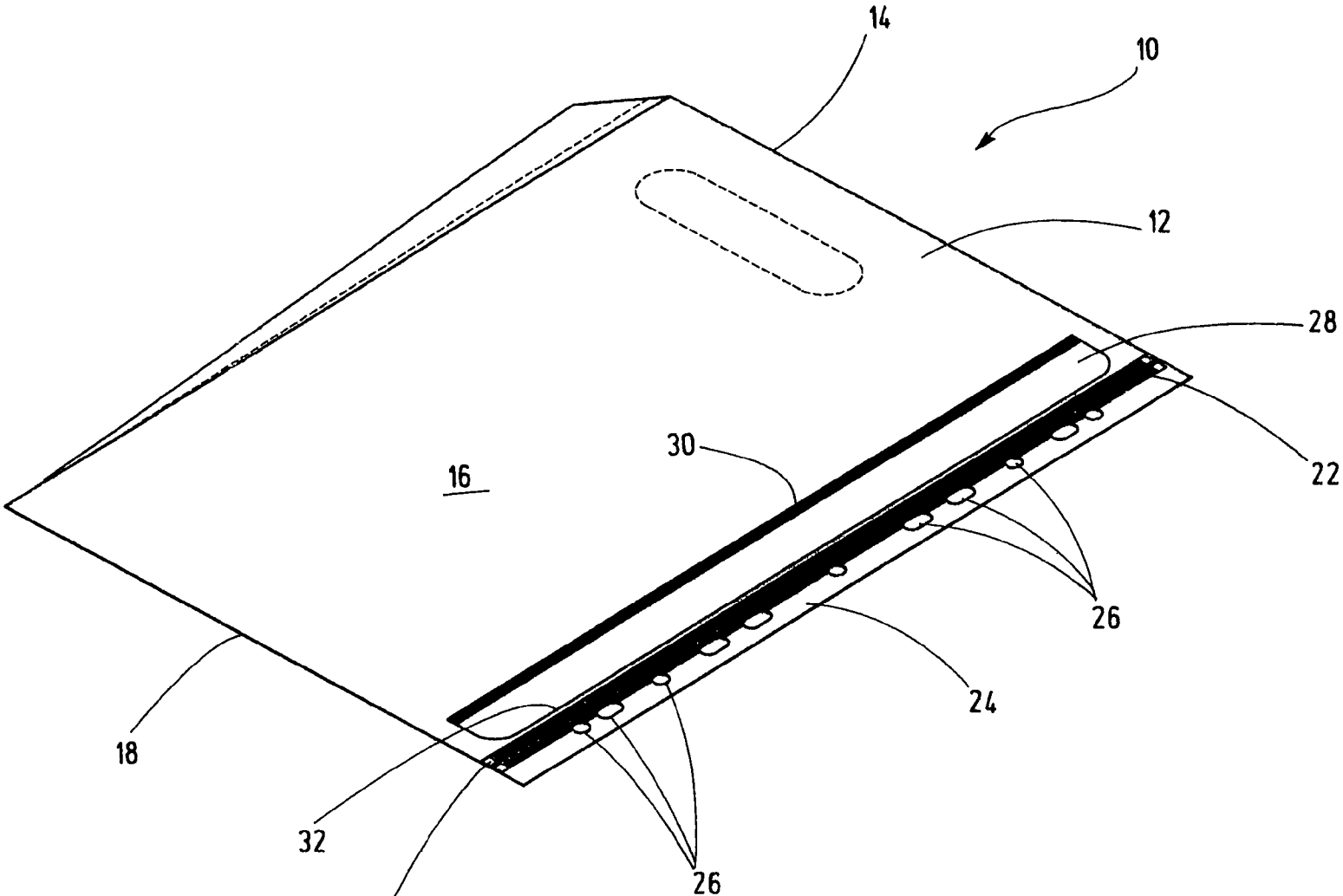

This application is the National Stage of PCT/EP2007/057621 filed on Jul. 24, 2007, which claims priority under 35 U.S.C. §119 of German Application No. 10 2006 037 611.0 filed on Aug. 10, 2006. The international application under PCT article 21(2) was not published in English.

The invention relates to a document protector.

Document protectors have a document pocket for accommodating documents that can be stored, in protected manner, in the document pocket. They are predominantly used where individual sheets of documents are supposed to be transported, for example for a presentation. The document can be accommodated in the document pocket without being punched. If the document is no longer needed, for the time being, and if it is supposed to be filed in a file folder, a ring binder, or the like, it has to be removed from the document protector and also punched, if necessary. For this reason, document protectors have already been developed that have a punched reinforcement strip formed on in one piece with the document pocket, having holes for accommodating the filing posts of file folders and the like. Such document protectors can be filed in file folders, together with the document contained in the document pocket. When handling these document protectors, however, it is felt to be disadvantageous that the punched reinforcement strip increases their dimensions, and gets in the way, for example during presentation of the document contained in the protector. Furthermore, document protectors are known, which have a labeling strip formed on in one piece with the document pocket, for applying identification. The labeling strip has an insertion pocket for accommodating a labeling sign, for example. In this connection, it is again felt to be disadvantageous that the labeling strip increases the dimensions of the document protector, thereby making it less easy to handle.

Document protectors are known from AT-280944 B and EP-A-0 142 489, which are provided with a punched reinforcement strip, in each instance, which can be folded down in order to reduce their dimensions. Document protectors that are provided with a labeling sign that is guided in displaceable manner, in each instance, are known from DE 15 36 654 A1 and DE 1 104 488 B.

It is therefore the task of the invention to further develop a document protector of the type stated initially, in such a manner that its handling is improved.

This task is accomplished by means of a document protector according to the invention. Advantageous further developments are discussed below.

The invention is based on the idea that the punched reinforcement strip provides a simple possibility for filing the document in a file folder, without having to remove the document from the document pocket. In daily use, the document protector is easy to handle, since the punched reinforcement strip is movable, both in the case of the first embodiment, and in the case of the second embodiment, relative to the document pocket, and can be brought into a position in which the dimensions of the document protector, as compared with those of a document protector without a punched reinforcement strip, are not significantly increased. This is done, in the case of the first embodiment, by means of folding the punched reinforcement strip about the fold, and, in the case of the second embodiment, by means of insertion into the insertion pocket. In general, the front cover is made from a transparent plastic film, while the back cover can also be produced from non-transparent plastic, and furthermore can be structured to be thicker than the front cover.

According to the first embodiment, it is provided that the document protector has a holder strip fixing the punched reinforcement strip in place in the folded-down position. This prevents the punched reinforcement strip from folding back unintentionally after it has been folded down. It is practical if the holder strip is affixed to the back cover, since when the punched reinforcement strip is folded down onto the back cover, the punched reinforcement strip disappears under a document protector that is lying on a table, and is not in the way. The holder strip is made of plastic film, and engages over the folded-down punched reinforcement strip. The holder strip is preferably attached to the document pocket by means of a weld seam. When the punched reinforcement strip is folded down, the holder strip is lifted up, and the punched reinforcement strip is held down under it, lying against the front cover or back cover.

In the case of the second embodiment, it is preferred that the insertion pocket ends flush with the first side edge. When the punched reinforcement strip has been pushed completely into the insertion pocket, the dimensions of the document protector are not greater than the dimensions of a conventional document protector without a punched reinforcement strip. The punched reinforcement strip has perforations as guides, through which a guide element that connects the document pocket with the film strip that is set on, in each instance, passes. The punched reinforcement strip can be displaced relative to the guide elements, between two stops that define the first and the second position. The guide elements can be clasps that connect the film strip with the document pocket. However, it is preferred that the guide elements are weld seams. It is advantageous if the film strip that is set on has a grasping cut-out for taking hold of the punched reinforcement strip, at the opening of the insertion pocket.

In the case of both embodiments, the holes project beyond the outline of the document pocket in the first position of the punched reinforcement strip.

In the case of the first embodiment, the punched reinforcement strip can be formed on in one piece with the document pocket, either onto the front cover or onto the back cover. Preferably, it is structured in two layers, for example by means of folding. This makes it more stable. However, it is also possible to set the punched reinforcement strip onto the front or back cover and attach it to this cover. For attachment, the punched reinforcement strip is preferably welded on. In both variants, the document protector can continue to be used even after removal of the punched reinforcement strip.

It is possible that the punched reinforcement strip has an insertion pocket for accommodating a labeling sign. The various embodiments can also be combined with one another.

It is practical if the document pocket is closed on its first side edge and on a lower edge that runs crosswise to the first side edge. Furthermore, it can be closed part of the way on its second side that lies opposite the first side edge, proceeding from the lower edge. This prevents the document accommodated in the document pocket from slipping out, particularly if the document protector is filed in a file folder that stands upright.

According to an advantageous further development, the back cover has a corner piece made of plastic film, for insertion of a corner section of the front cover, at the corner that lies opposite the side edge and the lower edge, which corner piece covers the inside of the back cover that faces the front cover, part of the way. The document contained in the document pocket is also inserted between this corner piece and the back cover. In this way, the document is held better in the document pocket, and the front cover is prevented from folding open. In order to be able to put the front cover under the corner piece well, it is practical if this piece has a contour that is set back relative to the outline of the document pocket, at its corner section.

The document pocket can be divided into multiple compartments, between the front cover and the back cover, by means of one or more intermediate films. This makes it possible for multiple sheets of a document to be accommodated in the document pocket, in presorted manner.

Figure 1B:
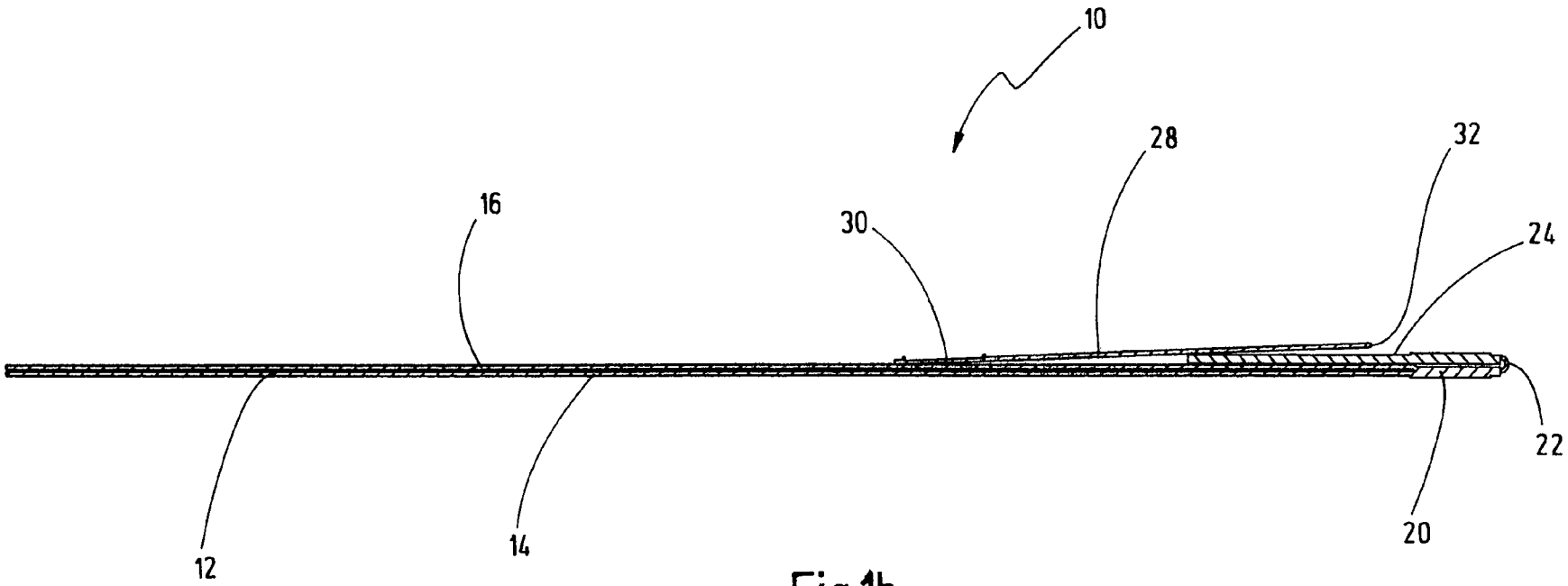

The invention will be described in the following, using exemplary embodiments shown schematically in the drawing. The figures show:

FIG. 1*a* a document protector according to a first exemplary embodiment, in a perspective rear view;

FIG. 1*b* a section through the document protector according to FIG. 1*a;*

Figure 2A:
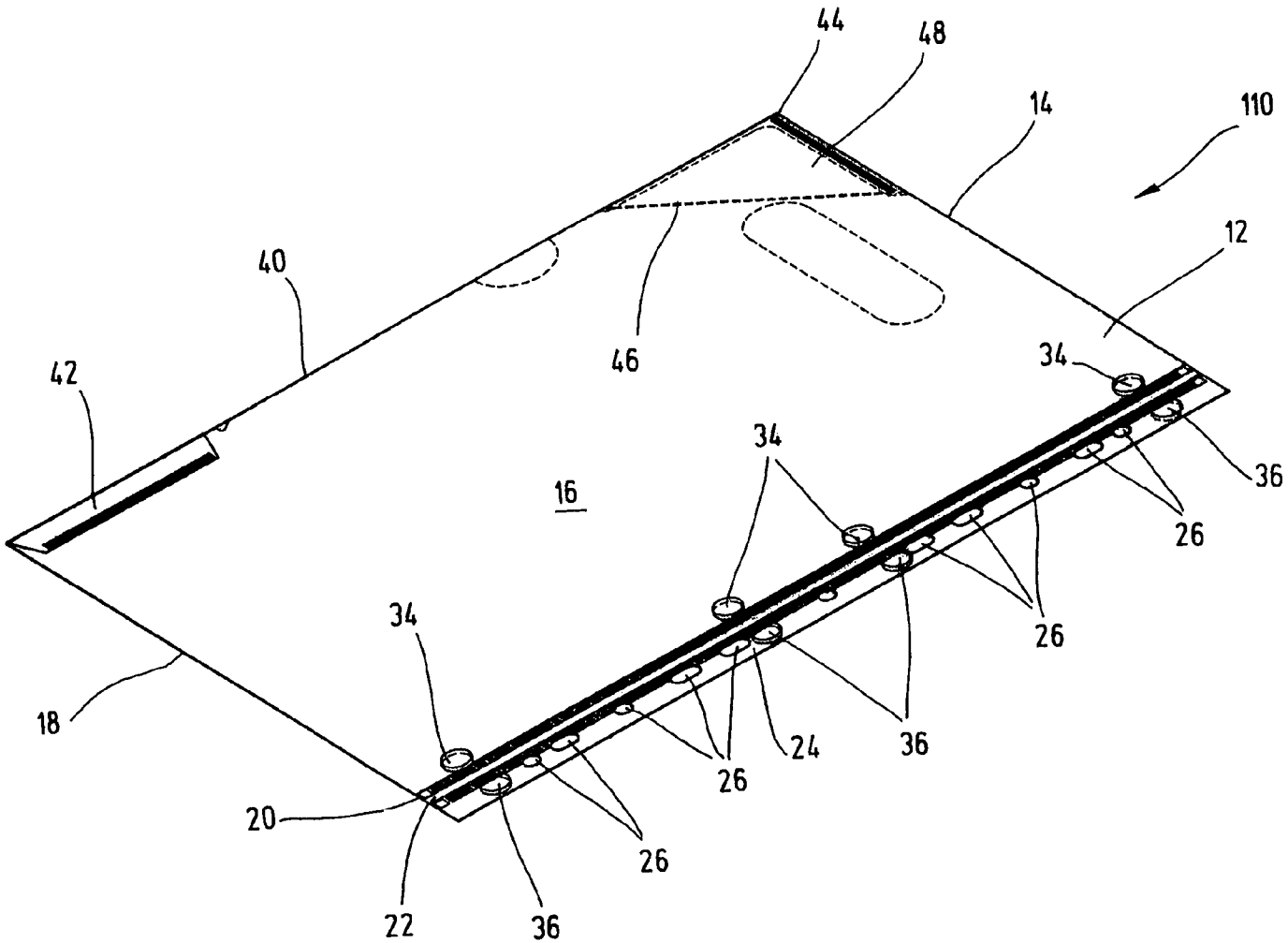
Figure 2B:
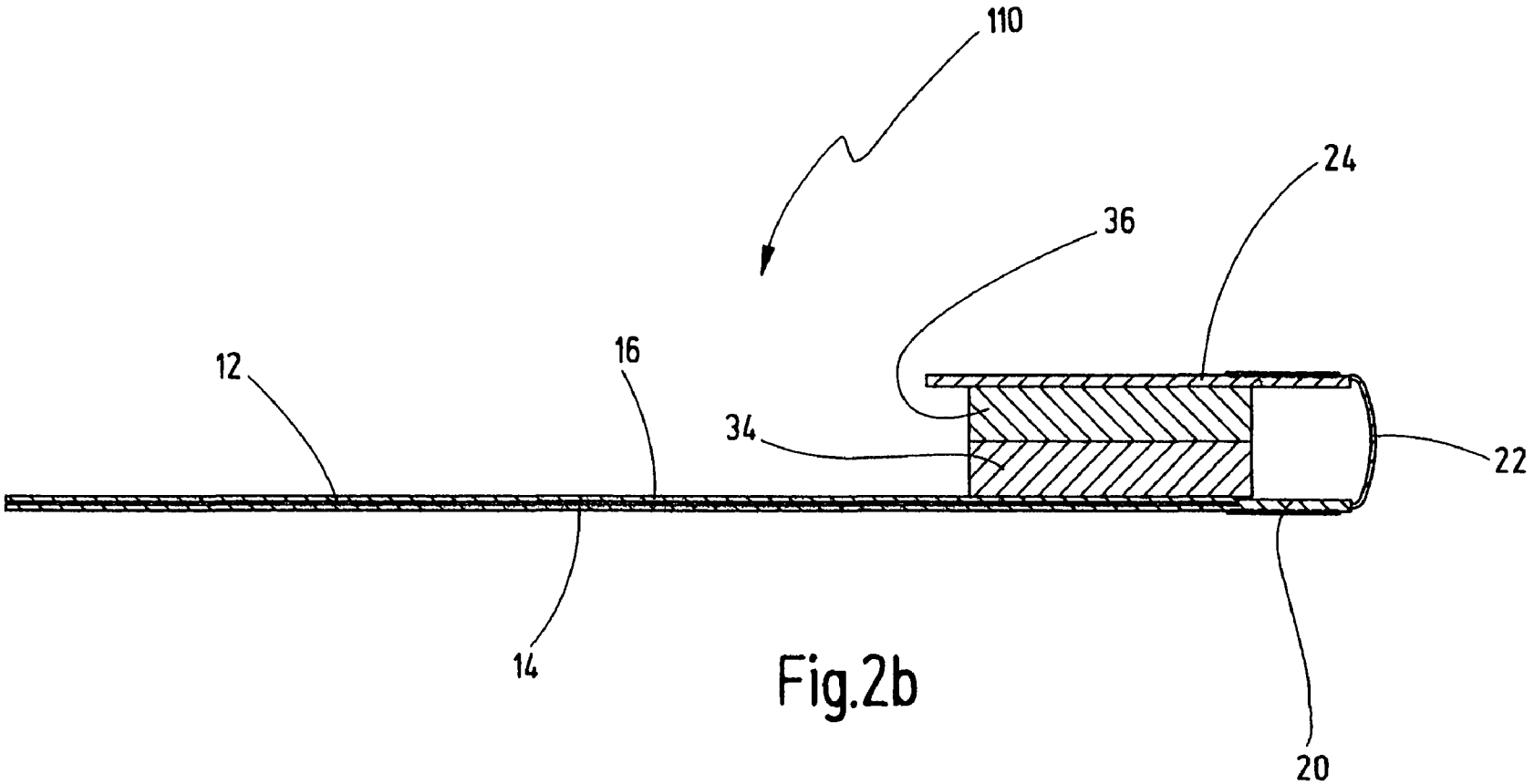

FIG. 2*a* a document protector according to a second exemplary embodiment, in a perspective rear view;

FIG. 2*b* a detail representation of a section through the document protector according to FIG. 2*a;*

Figure 3A:
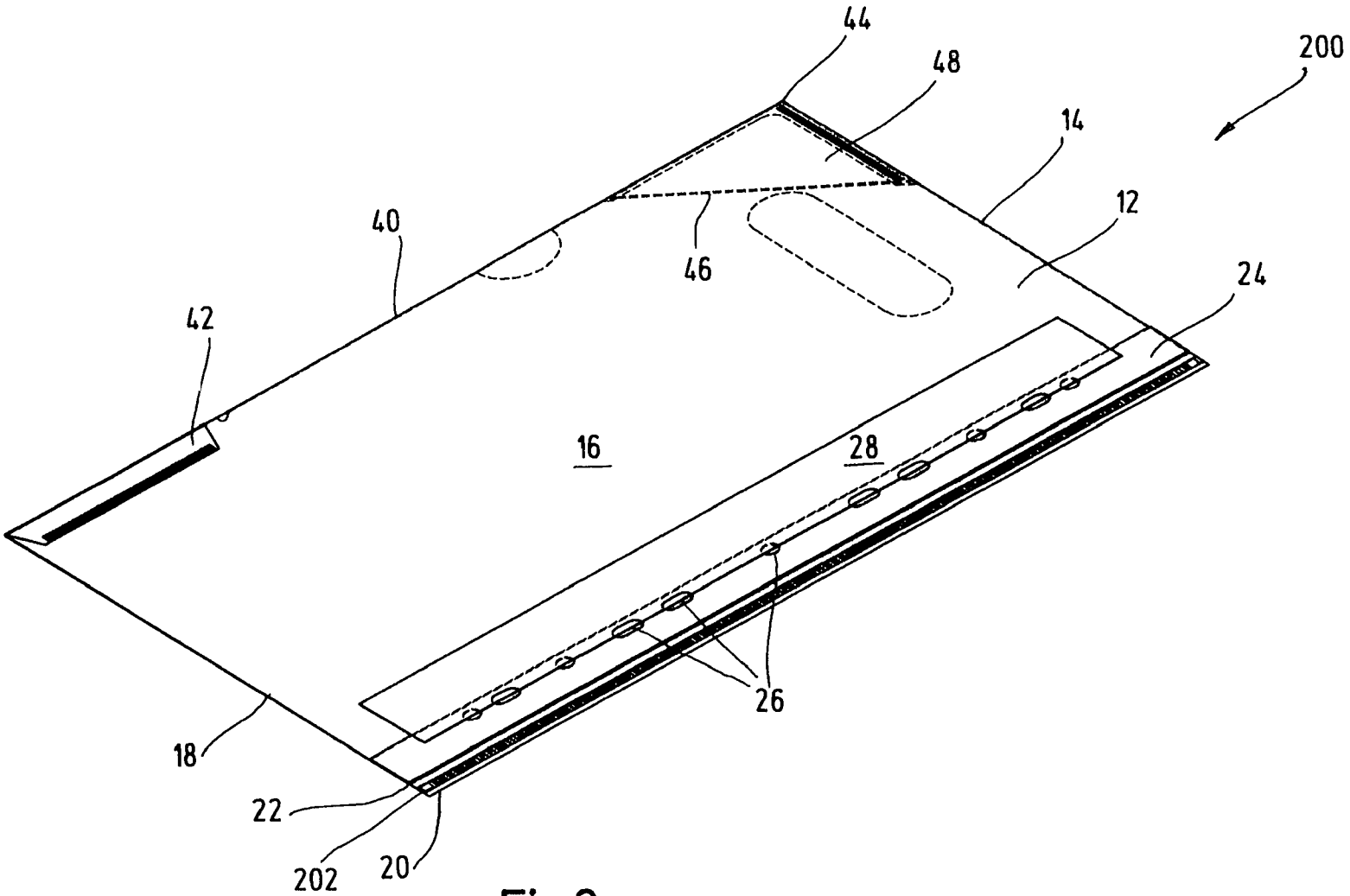
Figure 3B:
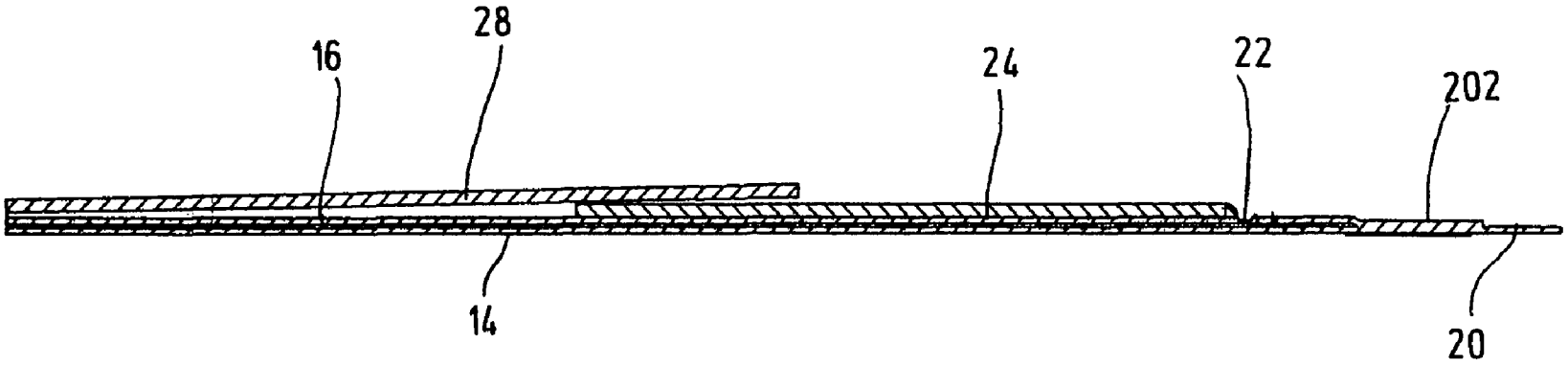
Figure 4A:
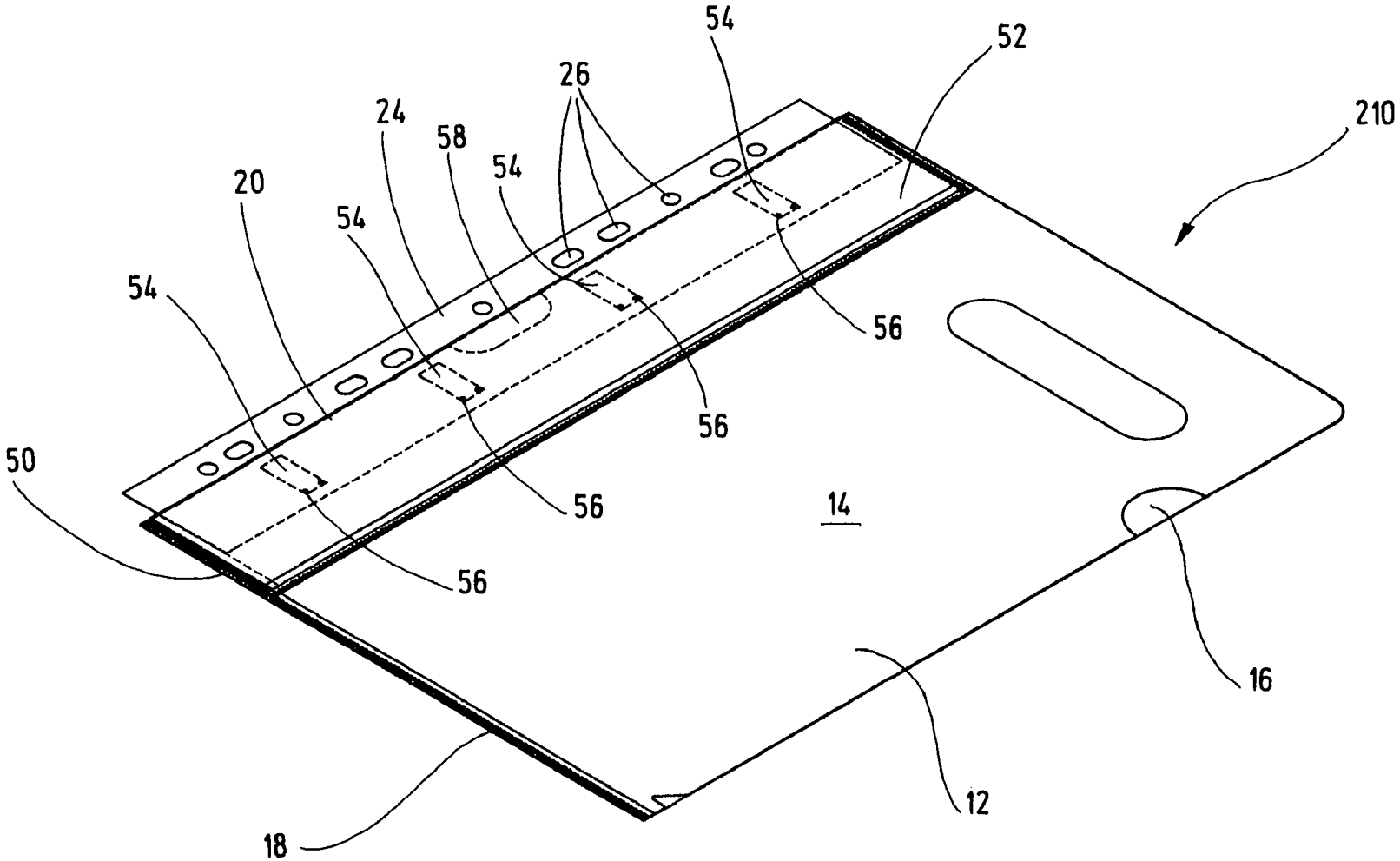
Figure 4B:
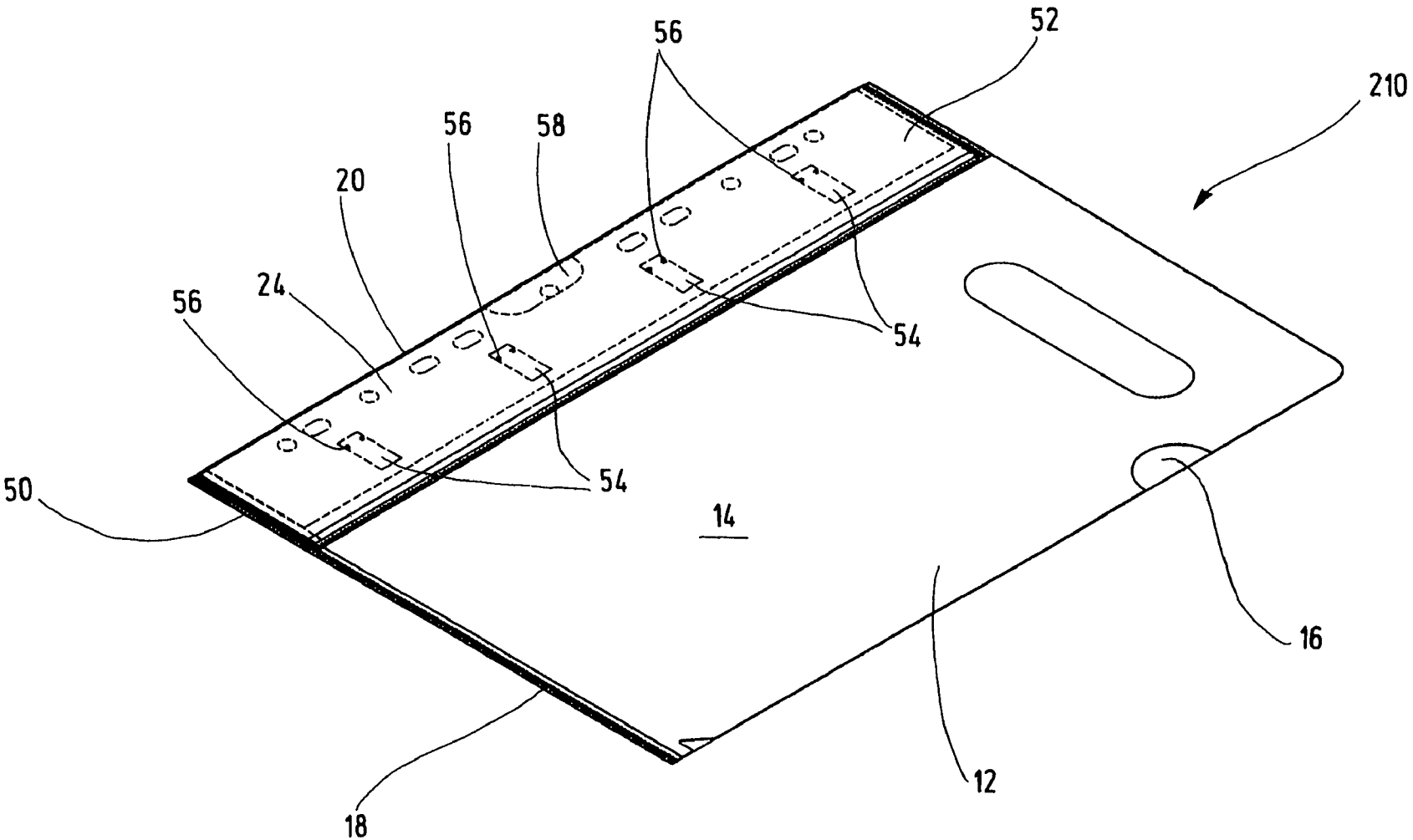

FIG. 3*a* a document protector according to a third exemplary embodiment, in a perspective rear view;

FIG. 3*b* a detail representation of a section through the document protector according to FIG. 3*a*; and FIG. 4*a*, 4*b* a document protector according to a fourth exemplary embodiment, in a perspective front view, with the punched reinforcement strip pulled out and pushed in.

A document protector 10 according to a first exemplary embodiment (FIG. 1*a*, 1*b*) has a document pocket 12 for accommodating documents. The document pocket 12 is formed by a front cover 14 and a back cover 16 made of a piece of transparent plastic film, which is folded about a lower edge 18, which separates the front cover 14 from the back cover 16. The front and back cover 14, 16 are welded to one another at a first side edge 20 that runs crosswise to the lower edge 18. A fold 22 runs parallel to the first side edge 20 and following it; a punched reinforcement strip 24 is formed on in one piece with the document pocket 12, by way of this fold. The punched reinforcement strip 24 has holes 26 that are intended to accommodate filing posts of a file folder. The punched reinforcement strip 24 can be folded down until it lies against the back cover 16, about the fold 22. Furthermore, a holder strip 28 made of the same plastic material of which the front and back cover 14, 16 also consist is welded onto the back cover 16. The weld seam 30, with which the holder strip 28 is attached to the back cover 16, extends along a longitudinal edge of the holder strip 28, while the other longitudinal edge 32, which faces the punched reinforcement strip 24, is free, so that the holder strip 28 can be bent up and the punched reinforcement strip 24 can be held under it, lying against the back cover 16 (FIG. 1*b*).

The document protector 110 according to the second exemplary embodiment (FIG. 2*a*, 2*b*) corresponds, in its structure, essentially to that of the document protector 10 according to the first exemplary embodiment. The same characteristics are therefore provided with the same reference symbols. In place of the holder strip 28, the document protector 110 has four parts of hook-and-loop closures 34 on its back cover 16; in each instance, a counterpart 36 to them is affixed to the punched reinforcement strip 24. After the punched reinforcement strip 24 has been folded down about the fold 22, it is held in its folded-down position by means of these hook-and-loop closures 34, 36. Furthermore, the document pocket 12 is also closed part of the way along its second side edge 40, proceeding from the bottom edge 18. For this purpose, a section 42 of the front cover 14 is bent over the back side of the back cover 16, and welded onto it. Finally, the back cover 16 has a triangular corner piece 46 made of plastic film, which overlaps its inside part of the way, on its corner 44 that lies opposite the first side edge 20 and the lower edge 18. A corner section 48 of the front cover is inserted between the corner piece 46 and the back cover 16. At the corner section 48, the outer contour of the front cover 14 is set slightly back, relative to the outline of the document pocket 12, in order to allow it to be inserted completely underneath the corner piece 46.

The document protector 200 according to the third exemplary embodiment (FIG. 3*a*, 3*b*) again corresponds, in its structure, essentially to the document protector 110 according to the second exemplary embodiment. In this regard, reference is made to the above description. Again, a holder strip 28 is welded onto the back cover 16, to hold the punched reinforcement strip 24 in place in the folded-down position, as was already the case with the first exemplary embodiment. However, the punched reinforcement strip 24 is not formed on in one piece with the document pocket 12. Instead, it is set onto the back cover 16 as a separate strip, and firmly connected with the latter by means of a weld seam 202. The fold 22 about which it can be folded down runs at a distance from and parallel to the first side edge 20. In FIG. 3*a*, the document protector 200 is shown with the punched reinforcement strip 24 folded down onto the back cover 16.

The document protector 210 according to the fourth exemplary embodiment (FIG. 4*a*, 4*b*), in which characteristics having the same effect are again identified with the same reference symbols, the punched reinforcement strip 24 cannot be folded down relative to the document pocket 12, but rather is displaceable relative to it, in linear manner. For this purpose, a film strip 50 made of the same material from which the front and back cover 14, 16 are also made is welded onto the back cover 16. The punched reinforcement strip 24 is inserted into the insertion pocket 52 delimited by the film strip 50 and the back cover 16, which is open towards the first side edge 20 and ends flush with it. This strip has four perforations 54, which serve as guides for point-shaped weld seams 56 that connect the film strip 50 with the back cover 16. Thus, the punched reinforcement strip 24 can be displaced between two positions, whereby in a first position, the holes 26 project beyond the outline of the document pocket 12, and in a second position (FIG. 4*b*), they are accommodated in the insertion pocket 52. In order to be better able to grasp the punched reinforcement strip 24, the film strip 50 has a grasping cut-out 58 close to the edge.

The punched reinforcement strips 24 shown in the exemplary embodiments can also perform additional functions. For example, they can serve, at the same time, as labeling strips, whose labeling allows identification of the document (s) contained in the document pocket 12. For this purpose, they can also be colored with a predefined color. Furthermore, in place of the punched reinforcement strip 24, a labeling strip or an insertion pocket for accommodating a labeling sign can be applied. The insertion pocket can also be used to accommodate other objects, such as pens or rulers. In particular, it is also possible that a document protector has two such strips, having different functions: a punched reinforcement strip on a first side edge, and a labeling strip or an insertion pocket on another edge of the document pocket 12.

In summary, the following should be stated:

The invention relates to a document protector 10, 110, 200, having a document pocket 12 for accommodating documents, delimited by a front cover 14 and a back cover 16 made of plastic film, and having a functional strip 24 that can be moved relative to the document pocket 12, which strip projects at least partially beyond the outline of the document pocket 12 at a first side edge 20, in a first position. According to the invention, it is provided that the functional strip 24 is firmly connected with the document pocket 12, and can be folded down onto the front cover 14 or the back cover 16 about a fold 22 that runs parallel to the first side edge 20, into a second position.

The invention claimed is:

1. Document protector having a document pocket for accommodating documents, delimited by a front cover and a back cover made of plastic film, and having a punched reinforcement strip that can be moved relative to the document pocket, which strip has holes for accommodating filing posts or filing bands, and projects at least partially beyond the outline of the document pocket at a first side edge, in a first position, and is firmly connected with the document pocket, and can be folded down onto the front cover or the back cover about a fold that runs parallel to the first side edge, into a second position, and whereby the holes project beyond the outline of the document pocket in the first position of the punched reinforcement strip, and further comprising a holder strip made of plastic film, attached to the document pocket, for engaging over the folded-down punched reinforcement strip and fixing the punched reinforcement strip in place in the second, folded-down position.

2. Document protector according to claim 1, wherein the punched reinforcement strip is formed on in one piece with the document pocket.

3. Document protector according to claim 1, wherein the punched reinforcement strip is attached to the front or back cover.

4. Document protector according to claim 1, wherein the holder strip is affixed to the back cover.

5. Document protector according to claim 1, wherein the holder strip is affixed to the document pocket by means of a weld seam.

6. Document protector according to claim 1, wherein the punched reinforcement strip has an insertion pocket for accommodating a labeling sign or the like.

7. Document protector according to claim 1, wherein the document pocket is closed on its first side edge and on a lower edge that runs crosswise to the first side edge.

8. Document protector according to claim 7, wherein the document pocket is closed part of the way on its second side edge that lies opposite the first side edge, proceeding from the bottom edge.

9. Document protector according to claim 8, wherein the back cover has a corner piece made of plastic film, for insertion of a corner section of the front cover, at the corner that lies opposite the first side edge and the lower edge, which corner piece covers the inside of the back cover that faces the front cover, part of the way.

10. Document protector according to claim 9, wherein the front cover has a contour that is set back relative to the outline of the document pocket, at its corner section.

* * * * *